US007733204B2

(12) United States Patent
Hahn et al.

(10) Patent No.: US 7,733,204 B2
(45) Date of Patent: Jun. 8, 2010

(54) CONFIGURABLE MULTIPHASE COUPLED MAGNETIC STRUCTURE

(75) Inventors: Jae-Hong Hahn, Beaverton, OR (US); Jorge Rodrignez, Portland, OR (US); Don Nguyen, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 924 days.

(21) Appl. No.: 11/478,188

(22) Filed: Jun. 29, 2006

(65) Prior Publication Data

US 2008/0001693 A1 Jan. 3, 2008

(51) Int. Cl.
*H01F 27/02* (2006.01)

(52) U.S. Cl. ..... 336/83

(58) Field of Classification Search ..... 336/170, 336/173, 178, 180–184, 212–215, 233–234, 336/5–12

See application file for complete search history.

(56) References Cited

U.S. PATENT DOCUMENTS 3,611,224 A * 10/1971 Becker ..... 336/5
5,182,535 A * 1/1993 Dhyanchand ..... 336/12
6,313,727 B1 * 11/2001 Gabriel ..... 336/174
6,429,765 B1 * 8/2002 Valdemarsson et al. ..... 336/212
6,690,145 B2 2/2004 Stevens et al.
6,901,817 B2 6/2005 Koga et al.
6,909,352 B2 * 6/2005 Hobson et al. ..... 336/178
6,933,822 B2 8/2005 Haugs et al.
7,042,323 B2 * 5/2006 Joerg et al. ..... 336/184

OTHER PUBLICATIONS

"PCT International Search Report for PCT/US2007/072291", dated Dec. 27, 2007, 2pgs.

* cited by examiner

*Primary Examiner*—Tuyen Nguyen
(74) *Attorney, Agent, or Firm*—Buckley, Maschoff & Talwalkar LLC

(57) ABSTRACT

In some embodiments, a configurable multiphase coupled magnetic structure may include a four-sided pot core defining an interior space, one or more cylindrical cores disposed within the interior space of the four-sided pot core, and at least two windings respectively wound around the one or more cylindrical cores, wherein the at least two windings are connected in a multiphase power delivery configuration. The windings may be multi-turn windings. The four-sided pot core may be a rectangular-shaped pot core. The cylindrical cores may be I-cores. Other embodiments are disclosed and claimed.

8 Claims, 4 Drawing Sheets

CONFIGURABLE MULTIPHASE COUPLED MAGNETIC STRUCTURE

The invention relates to voltage regulators including coupled magnetic structures. More particularly, some embodiments of the invention relate to a configurable multiphase coupled magnetic structure.

BACKGROUND AND RELATED ART

Many electronic systems require or benefit from the use of power delivery devices. For example, electronic systems such as microprocessor-based systems or digital signal processor based systems may require substantial power consumption. Power supply designs with smaller size and higher efficiency are generally more desirable. One type of voltage regulator topology that may meet the high output current demand of some electronic systems is the multiphase interleaved DC-DC converter.

For example, a DC-to-DC converter may include a switch and a low pass filter. Control circuitry may control a duty cycle of the switch so that the output voltage is regulated within a certain range. Typically a free wheeling diode or synchronous switch may be connected between ground and an inductor to provide a current path when the switch is opened. When higher current is required, multiple interleaved phases may be used.

Multiphase interleaving structures may require many inductors. To reduce components count, a coupled magnetic structure may be adopted. Even though the coupled magnetic structure has many advantages, manufacturing some coupled magnetic structures may be relatively complex and some coupled magnetic structures may provide limited design flexibility.

For example, a two-phase converter may be constructed with a toroidal core coupled magnetic structure. Even though the structure is simple, manufacturing may require a special winding tool. A multiphase converter may also be constructed with an H-core coupled magnetic structure. Although manufacturing may be easier than the toroidal approach, design flexibility is limited because the structure uses only a single turn winding (which may make it difficult to provide a high inductance value).

BRIEF DESCRIPTION OF THE DRAWINGS

Various features of the invention will be apparent from the following description of preferred embodiments as illustrated in the accompanying drawings, in which like reference numerals generally refer to the same parts throughout the drawings. The drawings are not necessarily to scale, the emphasis instead being placed upon illustrating the principles of the invention.

DESCRIPTION

In the following description, for purposes of explanation and not limitation, specific details are set forth such as particular structures, architectures, interfaces, techniques, etc. in order to provide a thorough understanding of the various aspects of the invention. However, it will be apparent to those skilled in the art having the benefit of the present disclosure that the various aspects of the invention may be practiced in other examples that depart from these specific details. In certain instances, descriptions of well known devices, circuits, and methods are omitted so as not to obscure the description of the present invention with unnecessary detail.

Figure 1:
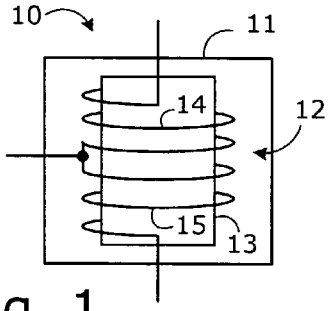
FIG. 1 is a schematic representation of a coupled magnetic structure in accordance with some embodiments of the invention.

With reference to FIG. 1, a coupled magnetic structure 10 includes a four-sided pot core 11 defining an interior space 12. One or more cylindrical cores 13 may be disposed within the interior space 12 of the four-sided pot core 11. At least two windings 14, 15 may be respectively wound around the one or more cylindrical cores 13. The at least two windings 14, 15 may be connected in a multiphase power delivery configuration. For example, FIG. 1 illustrates a coupled magnetic structure 10 with the windings 14, 15 configured for a two-phase power delivery configuration.

For example, the at least two windings may include at least two multi-turn windings. For example, FIG. 1 illustrates a single cylindrical core 13 with two windings 14, 15 wound around the single cylindrical core 13. In some embodiments, the single cylindrical core 13 may be an I-core. In some embodiments, the four-sided pot core 11 may be a rectangular-shaped pot core (e.g. including a square-shaped pot core).

Figure 2:
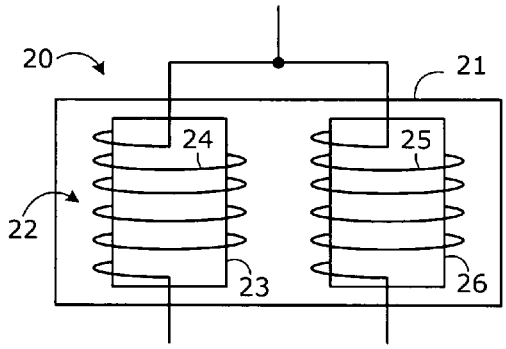
FIG. 2 is a schematic representation of another coupled magnetic structure in accordance with some embodiments of the invention.

With reference to FIG. 2, a coupled magnetic structure 20 includes a four-sided pot core 21 defining an interior space 22. One or more cylindrical cores 23, 26 may be disposed within the interior space 22 of the four-sided pot core 21. At least two windings 24, 25 may be respectively wound around the one or more cylindrical cores 23, 26. The at least two windings 24, 25 may be connected in a multiphase power delivery configuration. For example, FIG. 2 illustrates a coupled magnetic structure 20 with the windings 24, 25 configured for a two-phase power delivery configuration.

For example, the at least two windings 24, 25 may include at least two multi-turn windings. For example, FIG. 2 illustrates two cylindrical cores 23, 26 with one winding wound around each of the two cylindrical cores 23, 26. In some embodiments the two cores 23, 26 may be I-cores. In some embodiments, the four-sided pot core 21 may be a rectangular-shaped pot core (e.g. including a square-shaped pot core).

Figure 3:
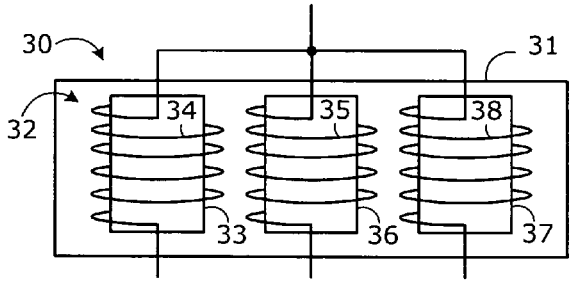
FIG. 3 is a schematic representation of a three phase coupled magnetic structure in accordance with some embodiments of the invention.

With reference to FIG. 3, a coupled magnetic structure 30 includes a four-sided pot core 31 defining an interior space 32. One or more cylindrical cores 33, 36, and 37 may be disposed within the interior space 32 of the four-sided pot core 31. At least two windings 34, 35, and 38 may be respectively wound around the one or more cylindrical cores 33, 36, 37. The at least two windings 34, 35, and 38 may be connected in a multiphase power delivery configuration. For example, FIG. 3 illustrates a coupled magnetic structure 30 with the windings 34, 35, and 38 configured for a three-phase power delivery configuration.

For example, the three windings 34, 35, and 38 may include three multi-turn windings. For example, FIG. 3 illustrates three cylindrical cores 33, 36, and 37 with one winding wound around each of the three cylindrical cores 33, 36, and 37. In some embodiments the three cores 33, 36, and 37 may be I-cores. In some embodiments, the four-sided pot core 31 may be a rectangular-shaped pot core (e.g. including a square-shaped pot core). Given the benefit of the present specification, those skilled in the art will appreciate that, in accordance with some embodiments of the invention, more or less cores and/or windings may be used as may be necessary or desirable for a particular application.

Figure 4:
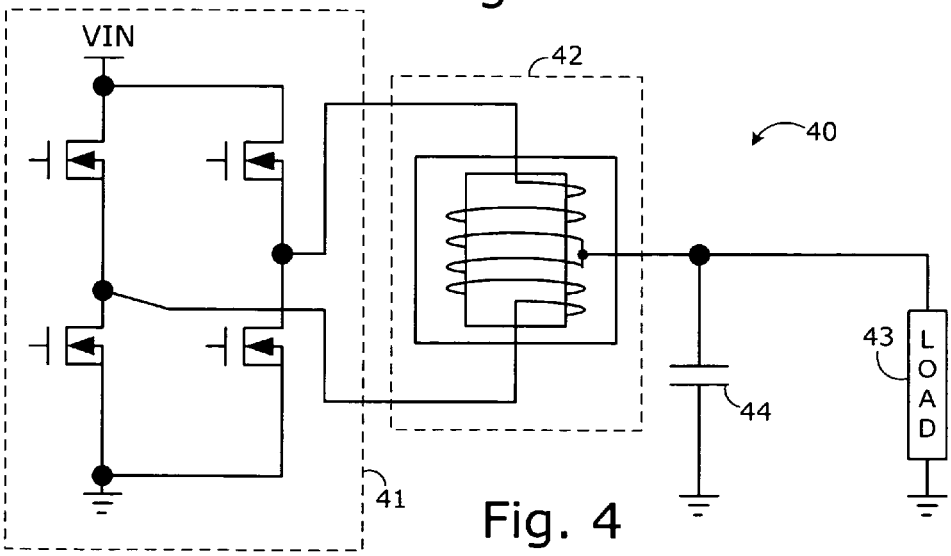
FIG. 4 is a schematic representation of a system including a coupled magnetic structure in accordance with some embodiments of the invention.
Figure 5:
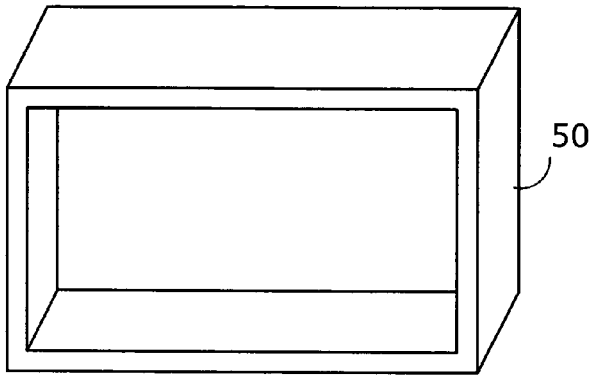
FIG. 5 is a perspective representation of a pot shaped core for use in a coupled magnetic structure in accordance with some embodiments of the invention.
Figure 6:
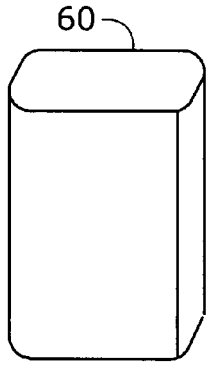
FIG. 6 is a perspective representation of an I-core for use in a coupled magnetic structure in accordance with some embodiments of the invention.
Figure 7:
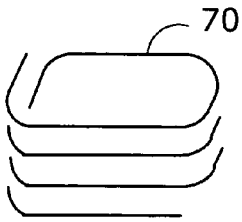
FIG. 7 is a perspective representation of a first multi-turn winding for use in a coupled magnetic structure in accordance with some embodiments of the invention.
Figure 8:
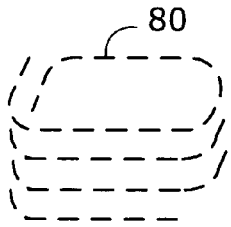
FIG. 8 is a perspective representation of a second multi-turn winding for use in a coupled magnetic structure in accordance with some embodiments of the invention.

With reference to FIG. 4, a power delivery system 40 includes a multiphase switching circuit 41, a coupled magnetic structure 42 coupled to the multiphase switching circuit 41, and a load 43 connected to an output of the coupled magnetic structure 42. The system 40 may further include an output decoupling capacitor 44 connected between the output of the coupled magnetic structure 42 and ground. In accordance with some embodiments of the invention, the coupled magnetic structure 42 may have any of the configurations described herein, including, for example, a four-sided pot core defining an interior space, one or more cylindrical cores disposed within the interior space of the four-sided pot core, and at least two windings respectively wound around the one or more cylindrical cores, wherein the at least two windings are connected in a multiphase power delivery configuration. For example, FIG. 4 illustrates a two-phase power delivery system.

For example, the at least two windings may include at least two multi-turn windings. For example, the coupled magnetic structure 42 may include a single cylindrical core with each of the at least two windings wound around the single cylindrical core (e.g. as illustrated in FIG. 1). For example, the one or more cylindrical cores may include two or more cylindrical cores with at least one winding wound around each of the two or more cylindrical cores (e.g. as illustrated in FIGS. 2 and 3). In the system 40, the cores may be I-cores and the four-sided pot core may be a rectangular-shaped pot core.

In general, the power delivery system 40 may be operated as a DC-to-DC converter as follows. Control circuitry may control the duty cycle of the switches in the switching circuit 41 so that the output voltage is regulated within a certain range. The switches may be connected between ground and the coupled magnetic structure 42 to provide a current path when the respective switches are opened. Multiple interleaved phases may be used to handle relatively large current. In the DC-DC step-down converter 40, the coupled magnetic structure provides an inductor for each phase. Half of the output power is handled by each phase. The system 40 can be designed with only one core with 3-terminals, as illustrated in FIG. 4.

With reference to FIGS. 5-9, some embodiments of the invention may provide a coupled magnetic structure for a multiphase voltage regulator. Advantageously, some embodiments of the invention may implement a coupled inductor circuit at low cost and with relatively simple manufacturing. In some embodiments, a coupled magnetic structure 90 may be manufactured from a pot-core structure 50 with separate windings 70, 80, and an I-core 60. For a two-phase voltage regulator, two windings 70, 80 may be wound around the I-core 60, and then positioned inside a rectangular or square-type pot-core 50.

Advantageously, all of these components can be manufactured separately and assembled later. Therefore, manufacturing cost may be lower than, for example, toroidal coupled magnetic structures. Advantageously, the number of turns in the windings can be changed in accordance with a required number of turns to provide a desired amount of inductance. Also, multi-turn windings may be advantageous in some embodiments to provide high inductance. Accordingly, some embodiments of the invention may provide more design flexibility and higher inductance than some H-core coupled magnetic structures (which may be limited to single turn windings).

Figure 9:
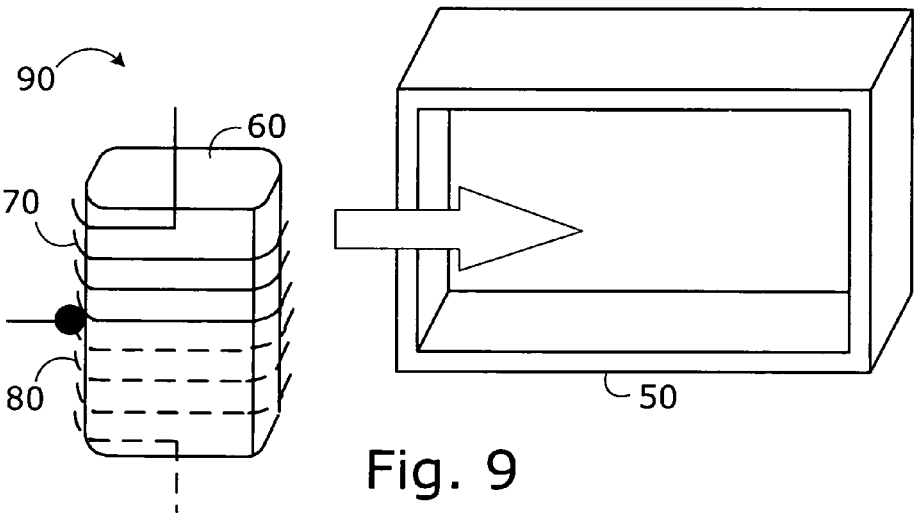
FIG. 9 is an exploded, perspective representation of a coupled magnetic structure in accordance with some embodiments of the invention.

As shown in FIG. 9, the two windings 70, 80 may be stacked on the I-core 60 and connected at a common terminal to provide a two-phase coupled magnetic structure 90. When assembled, the pot-type core 50 covers the windings 70, 80 and may provide a low reluctance magnetic path so that magnetic flux may be substantially contained within the coupled magnetic structure 90. Both windings 70, 80 may share the same magnetic path. Therefore, unbalance between the windings 70, 80 may be reduced or minimized. Because the space between the windings 70, 80 and the pot core 50 provides high reluctance, a magnetic link between the windings 70, 80 and the outer core 50 may also be reduced or minimized.

Without limiting the scope of the invention, a pot core generally has tall, thin sides enclosing an open interior. A rectangular-shaped pot core has cube shape with two opposed sides removed leaving four perpendicular sides enclosing an open interior (e.g. see pot core 50 in FIG. 5). Without limiting the scope of the invention, an I-core is similar to a cylindrical rod core, but has flat sides with a substantially rectangular shape (e.g. see I-core 60 in FIG. 6).

Figure 10:
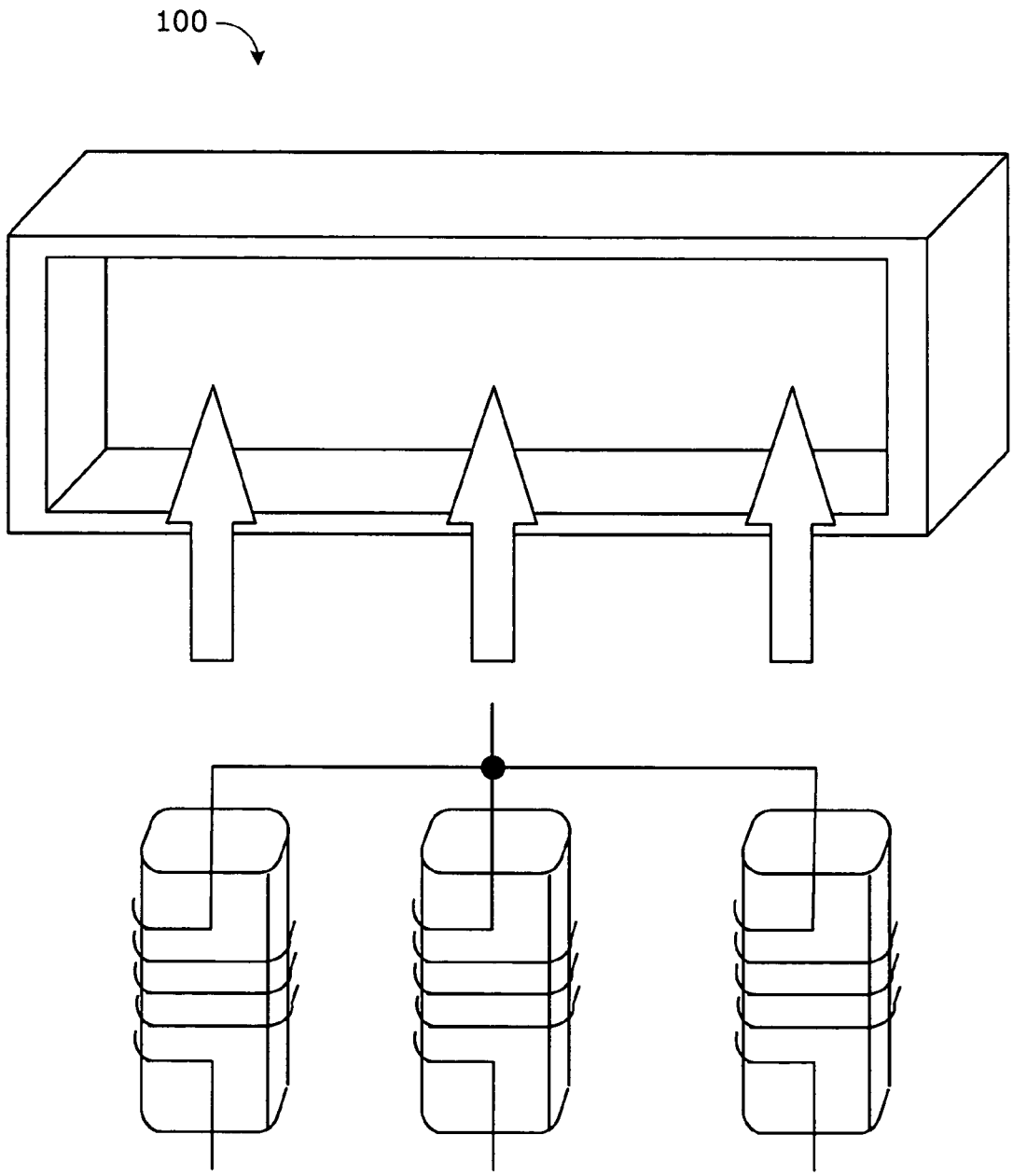
FIG. 10 is an exploded, perspective representation of a three phrase magnetic structure in accordance with some embodiments of the invention.

With reference to FIG. 10, another coupled magnetic structure 100 may include three I-cores with a multi-turn winding around each of the three I-cores. The three windings may be connected at a common terminal to provide a three-phase coupled magnetic structure.

As described herein, some embodiments of the invention may provide relatively simple manufacturing of a coupled magnetic structure while controlling the coupling factor of the windings. For example, some embodiments of the invention may be particularly suitable for a load requesting a large load current step, such as a processor or other high density integrated circuit. Advantageously, some embodiments of the invention may provide a reduction of the equivalent inductance at the output, thereby enabling higher bandwidth voltage regulator design, while greatly reducing the cost/area of power delivery on a printed circuit board.

Also, some embodiments of the invention may provide an inductor current slew rate which is very fast, thereby enabling a very shallow load-line capability. For example, the DC output voltage supplied to the load (e.g. CPU) can be lower. Accordingly, some embodiments of the invention may power reduction opportunities for the CPU during both average and Thermal Design Power (TDP) mode. Some embodiments of the invention may provide small or minimal footprint solutions that do not require very fast switching (e.g. >>300 KHz) voltage regulators, thereby enabling high efficiency designs.

Figure 11:
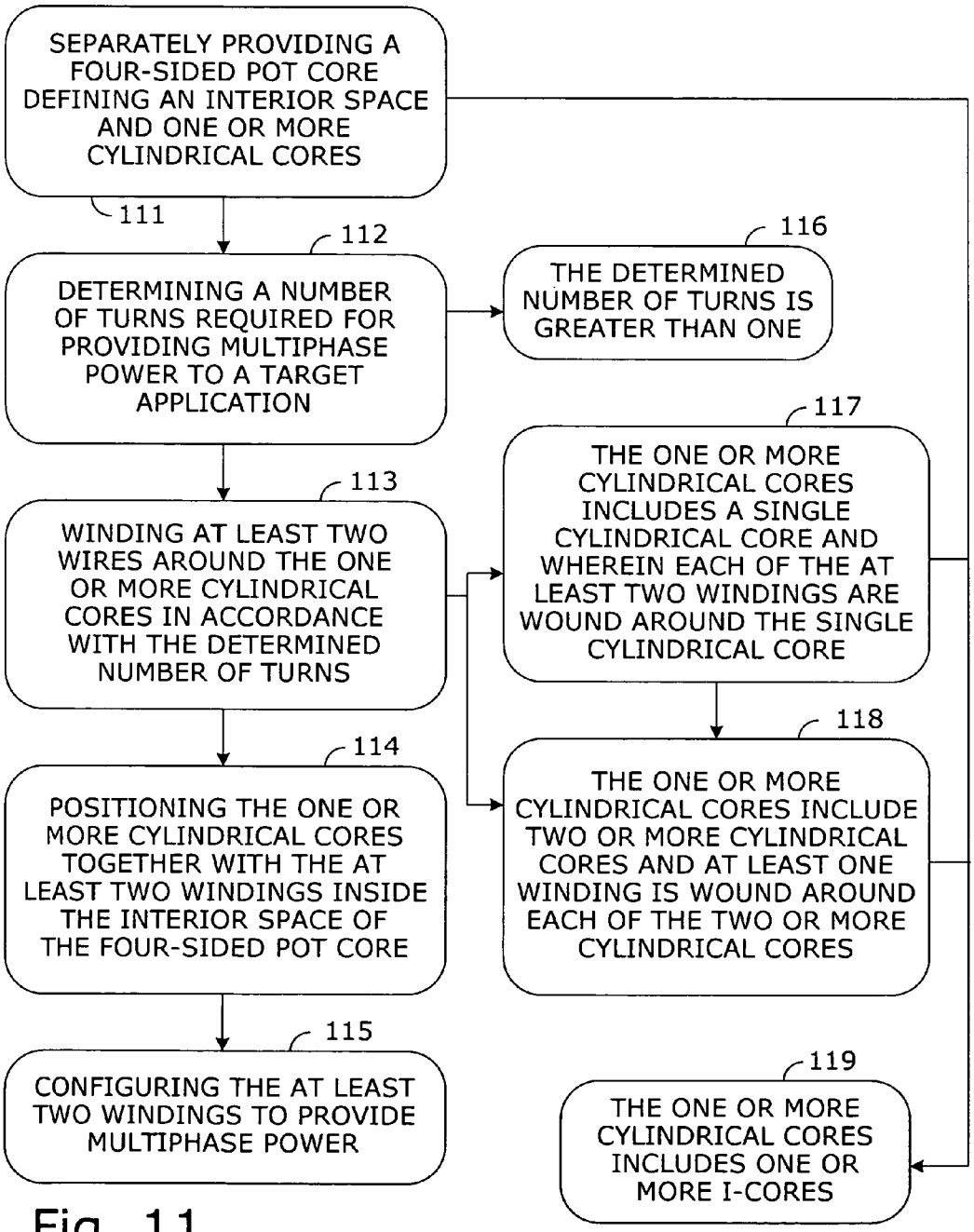
FIG. 11 is a flow diagram in accordance with some embodiments of the invention.

With reference to FIG. 11, some embodiments of the invention involve separately providing a four-sided pot core defining an interior space and one or more cylindrical cores (e.g. at block 110), separately providing a four-sided pot core defining an interior space and one or more cylindrical cores (e.g. at block 111), determining a number of turns required for providing multiphase power to a target application (e.g. at block 112), winding at least two wires around the one or more cylindrical cores in accordance with the determined number of turns (e.g. at block 113), positioning the one or more cylindrical cores together with the at least two windings inside the interior space of the four-sided pot core (e.g. at block 114), and configuring the at least two windings to provide multiphase power (e.g. at block 115).

For example, the determined number of turns may be greater than one (e.g. at block 116). In some embodiments, the one or more cylindrical cores may include a single cylindrical core and each of the at least two windings are wound around the single cylindrical core (e.g. at block 117). In some embodiments, the one or more cylindrical cores may include two or more cylindrical cores and at least one winding is wound around each of the two or more cylindrical cores (e.g. at block 118). In some embodiments, the one or more cylindrical cores may include one or more I-cores (e.g. at block 119).

The foregoing and other aspects of the invention are achieved individually and in combination. The invention should not be construed as requiring two or more of such aspects unless expressly required by a particular claim. Moreover, while the invention has been described in connection with what is presently considered to be the preferred examples, it is to be understood that the invention is not limited to the disclosed examples, but on the contrary, is intended to cover various modifications and equivalent arrangements included within the spirit and the scope of the invention.

What is claimed is:

1. An apparatus, comprising:

a first terminal;

a second terminal;

a third terminal;

a magnetic structure comprising:

a four-sided pot core that comprises a first side and a second side, wherein the four-sided pot core defines an open interior between the first side and the second side;

one or more cylindrical cores completely disposed within the open interior space of the four-sided pot core;

a first winding and a second winding respectively wound around the one or more cylindrical cores, wherein the first winding is coupled to the first terminal and the second winding is coupled to the second terminal; and an output of the magnetic structure coupled to the third terminal;

a multi-phase switching circuit coupled to the first terminal and the second terminal;

a capacitor coupled to the third terminal and ground; and a load coupled to the third terminal and ground.

2. The apparatus of claim 1, wherein the four-sided pot core comprises a rectangular-shaped pot core.

3. The apparatus of claim 1, wherein the first winding and a second winding comprise two multi-turn windings.

4. The apparatus of claim 1, wherein the one or more cylindrical cores comprises one or more I-cores.

5. The apparatus of claim 1, wherein the one or more cylindrical cores comprises a single cylindrical core and wherein each of the first winding and a second winding are wound around the single cylindrical core.

6. The apparatus of claim 5, wherein the single cylindrical core comprises an I-core.

7. The apparatus of claim 1, wherein the one or more cylindrical cores comprise two or more cylindrical cores and at least one winding is wound around each of the two or more cylindrical cores.

8. The apparatus of claim 7, wherein the one or more cylindrical cores comprises one or more I-cores.

* * * * *